US005647497A

United States Patent [19]

Labbé

[11] Patent Number: 5,647,497

[45] Date of Patent: Jul. 15, 1997

[54] PROTECTIVE REMOVABLE COVER FOR BEVERAGE CONTAINER

[76] Inventor: André Labbé, 14, rue Granada, Kirkland, Québec, Canada, H9H 3P8

[21] Appl. No.: 604,458

[22] Filed: Feb. 21, 1996

[51] Int. Cl.[6] ..... B65D 51/20

[52] U.S. Cl. ..... 220/257; 220/258; 220/269; 220/276; 220/359

[58] Field of Search ..... 220/257, 258, 220/259, 269, 276, 359, 716, 729

[56] References Cited

U.S. PATENT DOCUMENTS

| | | | |
|---|---|---|---|
| D. 274,792 | 7/1984 | Price . | |
| D. 332,403 | 1/1993 | Johnson . | |
| D. 353,328 | 12/1994 | Nuffer . | |
| 3,204,805 | 9/1965 | May | 220/257 |
| 3,438,533 | 4/1969 | Hanisch et al. | 220/257 |
| 3,601,253 | 8/1971 | Poupitch . | |
| 3,601,439 | 8/1971 | Poupitch . | |
| 3,627,121 | 12/1971 | Deasy . | |
| 3,690,509 | 9/1972 | Kinoian et al. | 220/716 |
| 3,744,626 | 7/1973 | Dreyfus . | |
| 3,756,395 | 9/1973 | Ganz . | |
| 3,811,561 | 5/1974 | Poupitch . | |
| 3,834,525 | 9/1974 | Morgese et al. . | |
| 4,116,331 | 9/1978 | Curry et al. . | |
| 4,273,273 | 6/1981 | Zenri . | |
| 4,281,502 | 8/1981 | Bonkowski . | |
| 4,586,742 | 5/1986 | Lew . | |
| 4,596,330 | 6/1986 | Benno . | |
| 4,606,454 | 8/1986 | Hambleton et al. . | |
| 4,708,257 | 11/1987 | Deline | 220/257 |
| 4,724,655 | 2/1988 | Lew . | |
| 4,749,100 | 6/1988 | Eberhart . | |
| 4,815,628 | 3/1989 | Wehnert . | |
| 4,848,565 | 7/1989 | Klygis . | |
| 4,911,290 | 3/1990 | Karabedian et al. . | |
| 4,913,304 | 4/1990 | Corey . | |
| 4,927,048 | 5/1990 | Howard | 220/716 |
| 5,065,862 | 11/1991 | Mousseau et al. . | |
| 5,088,269 | 2/1992 | Thelen . | |
| 5,105,964 | 4/1992 | Heath . | |
| 5,108,003 | 4/1992 | Granofsky . | |
| 5,119,955 | 6/1992 | Grafofsky . | |
| 5,131,554 | 7/1992 | Kuo | 220/258 |
| 5,139,163 | 8/1992 | Diaz . | |
| 5,285,924 | 2/1994 | Morris . | |
| 5,292,022 | 3/1994 | Blanco | 220/257 |
| 5,353,943 | 10/1994 | Hayward | 220/276 |
| 5,385,000 | 1/1995 | Bakhtyari . | |

*Primary Examiner*—Stephen K. Cronin

[57] ABSTRACT

A protective, low cost removable cover protects from dust, dirt, bacteria and the like a beverage container. This beverage container has a top wall formed with an outer surface, an opening member constituted by a partially stamped portion of the top wall, and an upwardly extending peripheral lip defining a top annular edge surface. The protective removable cover comprises a piece of sheet material covering at least a major portion of the partially stamped portion of the top wall, and is contoured to fit on the outer top wall surface inside the top annular edge surface. An annular strip of glue removably adheres the piece of sheet material to the outer top wall surface inside the top annular edge surface. The sheet material preferably comprises plastic, metal or composite material. Finally, the piece of sheet material may comprise a peripheral tab of any shape to facilitate manual removal thereof from the outer top wall surface.

10 Claims, 3 Drawing Sheets

PROTECTIVE REMOVABLE COVER FOR BEVERAGE CONTAINER

BACKGROUND OF THE INVENTION

1. Field of the Invention

The present invention relates to a low cost removable cover for protecting the top surface of a container, in particular but not exclusively a beverage can, against dust, dirt, bacteria and the like.

2. Brief Description of the Prior Art

The prior art has proposed many protective removable covers for beverage cans of the type comprising a top wall having (a) a partially stamped portion associated to a tab opener and (b) a generally vertical peripheral lip defining a top circular edge surface.

U.S. Pat. No. 4,708,257 (Deline) issued on Nov. 24, 1987, describes a protective removable cover formed of a thin film of metallic, plastic, paper or cellophane material, adhered to the top circular edge surface of the peripheral lip. The thin film has a diameter larger than the diameter of the top circular edge surface.

U.S. Pat. No. 4,749,100 granted to Ray Eberhart on Jun. 7, 1988, discloses a sanitary disposable lid detachably fastened to the peripheral lip of a beverage can. The lid overlies both the top wall and the peripheral lip of the can to prevent the entry of dirt prior to drinking of the beverage.

A drawback of the protective covers of U.S. Pat. Nos. 4,708,257 and 4,749,100 is that they both comprise a portion situated outside the top circular edge surface. Of course, this portion is likely to interfere with assembly of the beverage cans into well-known six packs.

Finally, U.S. Pat. No. 5,131,554 (Kuo) granted on Jul. 21, 1992, proposes a dust cover inserted between the top surface of the beverage can and the tab opener. The dust cover is situated inside the top circular edge surface of the peripheral lip but the periphery thereof is not sealed allowing dirt and bacteria to penetrate between the dust cover and the top wall of the beverage can.

OBJECT OF THE INVENTION

An object of the present invention is to overcome the above discussed drawbacks of the prior art.

SUMMARY OF THE INVENTION

More particularly, in accordance with the present invention, there is provided a protective, removable cover for a beverage container including a top wall having (a) an outer surface, (b) an opening means and (c) an upwardly extending peripheral lip defining a top annular edge surface. The protective removable cover comprises a piece of sheet material covering at least a major portion of the opening means and having an inner surface with a peripheral annular portion contoured to fit on the outer surface of the top wall inside the top annular edge surface, and means for removably adhering the peripheral annular portion to the outer surface of the top wall inside the top annular edge surface.

Accordingly, the protective removable cover of the invention has no portion situated outside the top annular edge surface of the peripheral lip whereby it will not interfere with assembly of the beverage cans into six packs. Also, the adhering means seals the peripheral annular portion of the piece of sheet material so that no dust, dirt, bacteria and the like can penetrate between the piece of sheet material and the top wall of the beverage container.

In the present disclosure and in the appended claims:

the term "annular" should be interpreted as qualifying a ring figure that can have a circular or any other shape;

a lip is considered "upwardly extending" as long as it comprises a top annular edge surface (it is not required that the lip be vertical);

"adhering" is meant to encompass sealed contact between two surfaces through glue or any other adhering substance or means;

"beverage" is meant to encompass any liquid that can be drunk such as soft drinks, juices, beer, etc.; and "container" is meant to encompass metallic cans, beverage cans, and any container including a top wall having (a) an outer surface and (b) an upwardly extending peripheral lip defining a top annular edge surface.

In accordance with a preferred embodiment of the protective, removable cover, (a) the outer surface of the top wall comprises a peripheral annular surface section adjacent the top annular edge surface, (b) the adhering means comprises a strip of glue interposed between the peripheral annular portion and the peripheral annular surface section, (c) the sheet material comprises plastic sheet material or sheet metal, and (d) the piece of sheet material comprises an inwardly extending peripheral tab to facilitate manual removal thereof from the outer surface of the top wall.

In accordance with another preferred embodiment of the protective, removable cover, (a) the adhering means comprises a strip of glue interposed between the peripheral annular portion and the outer wall surface of the top wall, (b) the sheet material comprises plastic sheet material or sheet metal, and (c) the piece of sheet material comprises a peripheral tab to facilitate manual removal thereof from the outer surface of the top wall.

In accordance with a third preferred embodiment of the protective, removable cover, (a) the opening means comprises a partially stamped portion of the top wall, (b) the beverage container further comprises a tab opener connected to the top wall for pushing the partially stamped portion into the beverage container, (c) the adhering means comprises a strip of glue interposed between the peripheral annular portion and the top wall inside the top annular edge surface but outside both the tab opener and the partially stamped top wall portion, (d) the sheet material comprises plastic sheet material or sheet metal, and (e) the piece of sheet material comprises a peripheral tab to facilitate manual removal thereof from the outer surface of the top wall.

The present invention also relates to a protective, removable cover for a container including a top wall having (a) an outer surface and (b) an upwardly extending peripheral lip defining a top annular edge surface. The protective removable cover comprises a piece of sheet material having an inner surface with a peripheral annular portion contoured to fit on the outer surface of the top wall inside the top annular edge surface, and means for removably adhering the peripheral annular portion to the outer surface of the top wall inside the top annular edge surface. Preferably, the outer surface of the top wall comprises a peripheral annular surface section adjacent the top annular edge surface, the adhering means comprises a strip of glue interposed between the peripheral annular portion and the peripheral annular surface section, the sheet material comprises plastic sheet material or sheet metal, and the piece of sheet material comprises an inwardly extending peripheral tab to facilitate manual removal thereof from the outer surface of the top wall.

The subject invention is further concerned with a protective, removable cover for a container including a top wall having (a) an outer surface and (b) an upwardly extending peripheral lip defining a top annular edge surface, the protective removable cover consisting of a piece of sheet material having a peripheral annular portion contoured to fit on the outer surface of the top wall inside the top annular edge surface, and a self-adhering inner surface for removably adhering the piece of sheet material to the outer surface of the top wall inside the top annular edge surface.

The objects, advantages and other features of the present invention will become more apparent upon reading of the following non restrictive description of a preferred embodiment thereof, given by way of example only with reference to the accompanying drawings.

DETAILED DESCRIPTION, OF THE PREFERRED EMBODIMENTS

Although the preferred embodiments of the present invention will be described hereinafter in relation to a beverage can, it should be kept in mind that the present invention is also applicable to any container or can as long as it comprises a top wall defining an outer surface and an upwardly extending peripheral lip defining a top annular edge surface.

Figure 1:
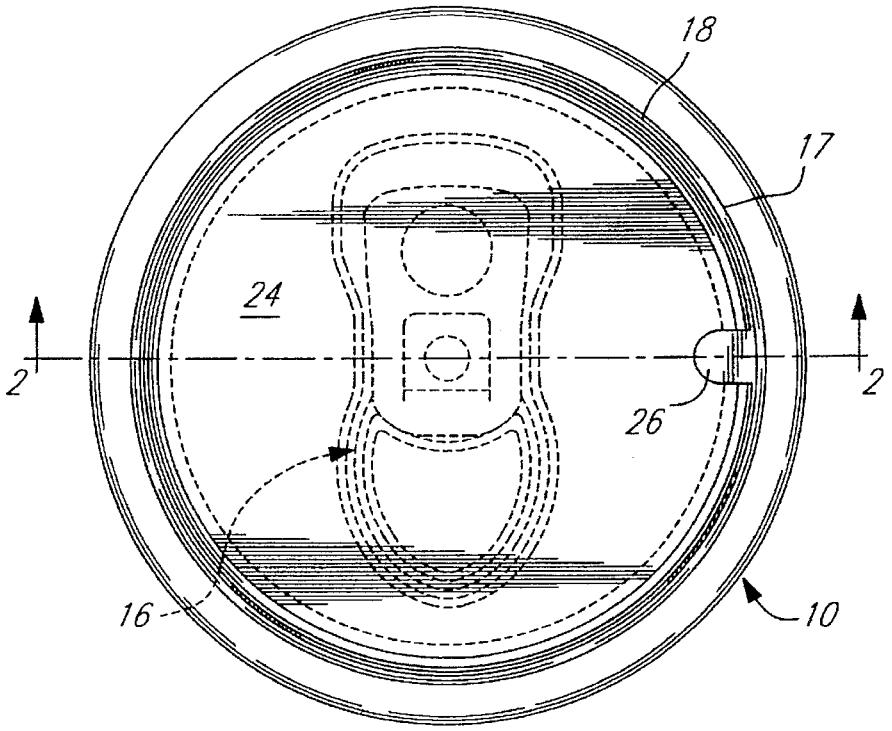
FIG. 1 is a top plan view of a first embodiment of the protective, removable cover according to the invention, installed onto a beverage can comprising a top wall.
Figure 2:
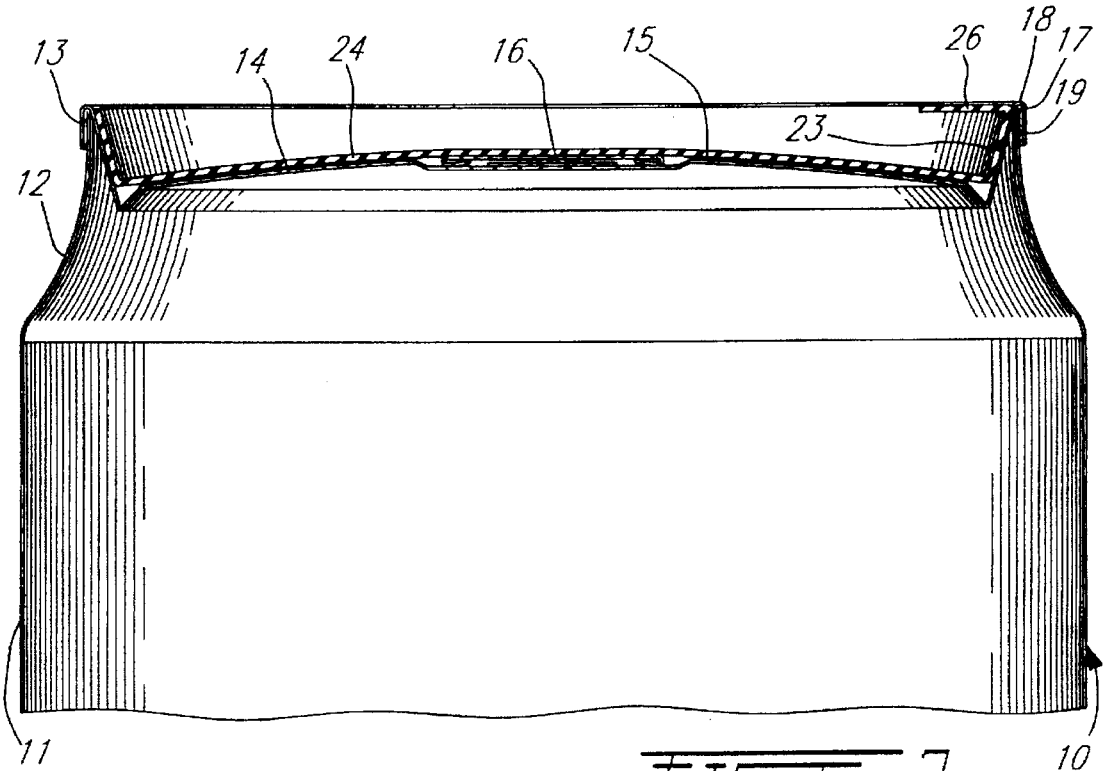
FIG. 2 is an elevational cross sectional view of the protective, removable cover of FIG. 1, taken along line 2—2 of FIG. 1.
Figure 3:
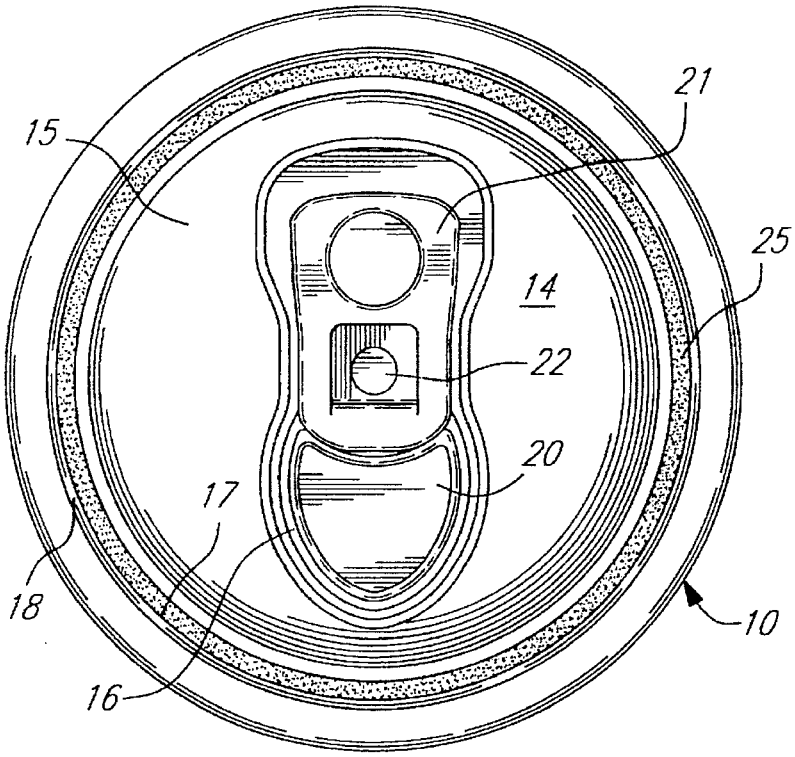
FIG. 3 is a top plan view of the beverage can of FIG. 1, showing the position of an annular strip of glue for adhering the protective, removable cover to the top wall of the can.

The beverage can is identified by the reference 10 in the appended drawings. Referring to FIGS. 1–3, the beverage can 10 comprises a bottom wall (not shown), and a generally cylindrical and vertical sidewall 11 formed with a generally tapered upper portion 12. Upper portion 12 is folded up to define a peripheral circular top end 13.

The beverage can 10 finally comprises a top wall 14 having (a) a top outer surface 15, (b) an opening means 16 and (c) an upwardly extending peripheral and circular lip 17 defining a top circular edge surface 18.

To form the lip 17, the top wall 15 is shaped to define a top shallow cavity (see FIG. 2) and the circular peripheral portion 19 thereof is bent over the circular top end 13 of the sidewall 11. This type of assembly is well known to those of ordinary skill in the art and accordingly, will not be further described in the present disclosure.

Regarding the opening means 16, it comprises, as illustrated in FIG. 3, a partially stamped portion 20 of the top wall 14. A tab opener 21 is connected to the top wall 14 outside the partially stamped top wall portion 20 by means of a rivet 22. To open the beverage can 10, the tab opener 21 is lifted and, therefore, pivots about the rivet 22 to push the partially stamped portion 20 into the beverage can 10. The stamped portion 20 remains attached to the top wall 14 through a non stamped tongue (not shown) interconnecting the top wall 14 with the partially stamped portion 20. This type of construction is also well known to those of ordinary skill in the art and accordingly will not be further described in the present disclosure.

A first embodiment of the protective, removable cover according to the invention is illustrated in FIGS. 1–3.

As shown in FIG. 2, the outer surface 15 of the top wall 14 comprises a peripheral circular surface section 23 adjacent the top circular edge surface 18.

According to the first embodiment, the protective, removable cover comprises a piece 24 of sheet material contoured to fit on the outer surface 15 of the top wall 14 inside the top circular edge surface 18 and outside the opening means 16. Preferably, the piece 24 of sheet material is also shaped to fit into the top shallow cavity formed by the top wall 14. The sheet material forming the piece 24 may comprises plastic sheet material, sheet metal or any other adequate sheet material.

To removably adhere the piece 24 of sheet material to the outer surface 15 of the top wall 14 inside the top circular edge surface 18 and outside the opening means 16, a strip of glue 25 (FIG. 3) may be first applied onto the peripheral circular surface section 23 and, then, the peripheral circular portion of the inner surface of the piece 24 of sheet material is applied to this strip of glue 25. The strip of glue 25 is therefore interposed between the peripheral circular surface section 23 and the peripheral circular portion of the inner surface of the piece 24 of sheet material. The strip 25 may comprise any glue or substance suitable to removably adhere the material forming the piece 24 to the surface section 23 of the beverage can 10, normally made of aluminum. It is believed to be within the skill of one of ordinary skill in the art to select a glue or other adhering substance capable of adhering the piece 24 of sheet material to the outer surface 15 while enabling easy removal of the piece 24 from the top wall 14. It should however be pointed out that any selected glue or adhering substance must be non toxic and present no hazard for human health.

As illustrated in FIGS. 1 and 2, the piece 24 of sheet material advantageously comprises an inwardly extending peripheral tab 26 to facilitate manual removal of the piece 24 of sheet material from the outer surface 15 of the top wall 14.

According to another alternative, the piece 24 of sheet material may be applied to the outer surface 15 of the top wall 14 in liquid state. Following its application, the liquid material dries to form the piece 24 of sheet material having a self-adhering inner surface for removably gluing the piece 24 on the surface 15. Many resinous, composite or other materials available on the market will enable application and adhering of the piece 24 of sheet material to the outer surface 15 in a single operation while enabling easy removal of this piece 24 from the top wall 14. It is believed to be within the skill of one of ordinary skill in the art to select a material suitable for that purpose.

FIGS. 4, 5, 6 and 7 show four other embodiments of the protective, removable cover in accordance with the present invention.

Figure 4:
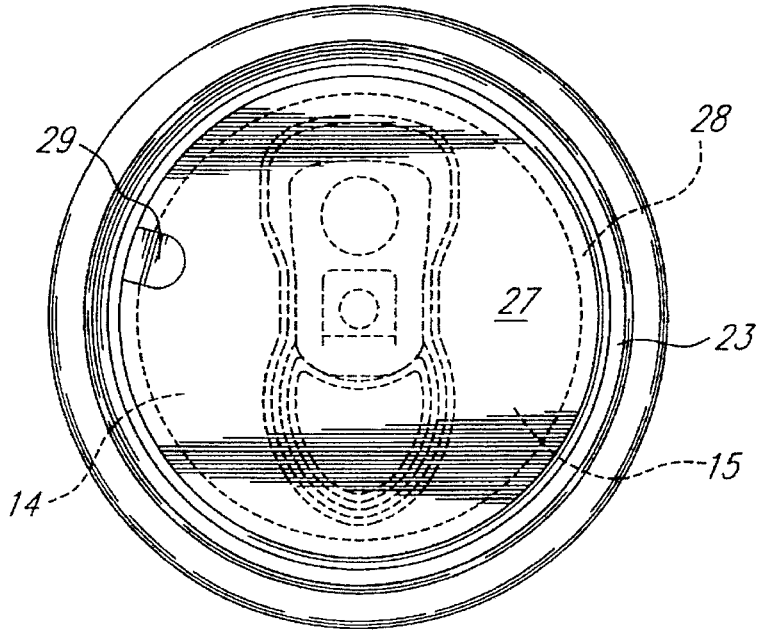
FIG. 4 is a top plan view of a second embodiment of the protective, removable cover according to the invention, installed onto a beverage can comprising a top wall.

In the embodiment of FIG. 4, the piece 27 of sheet material is contoured to fit on the outer surface 15 of the top wall 14 inside the peripheral circular surface section 23.

Again, the sheet material forming the piece 27 may comprises plastic sheet material, sheet metal or any other adequate sheet material. The strip of glue 28 is applied onto the outer surface 15 inside surface section 23 and, then, the peripheral circular portion of the inner surface of the piece 27 of sheet material is applied to this strip of glue 28. Of course, the strip 28 may comprise any glue or substance suitable to removably adhere the material forming the piece 27 to the surface 15 of the top wall 14 of the beverage can 10, normally made of aluminum. Finally, the piece 27 of sheet material advantageously comprises an inwardly extending peripheral tab 29 to facilitate manual removal of the piece 27 from the outer surface 15 of the beverage can 10.

Again, the piece 27 of sheet material may be applied to the outer surface 15 of the top wall 14 in liquid state. Following its application, the liquid material dries to form the piece 27 of sheet material having a self-adhering inner surface for removably gluing the piece 27 on the surface 15. It is believed to be within the skill of one of ordinary skill in the art to select a resinous, composite or other material enabling application and adhering of the piece 27 of sheet material to the outer surface 15 in a single operation while enabling easy removal of this piece 27 from the top wall 14.

Figure 5:
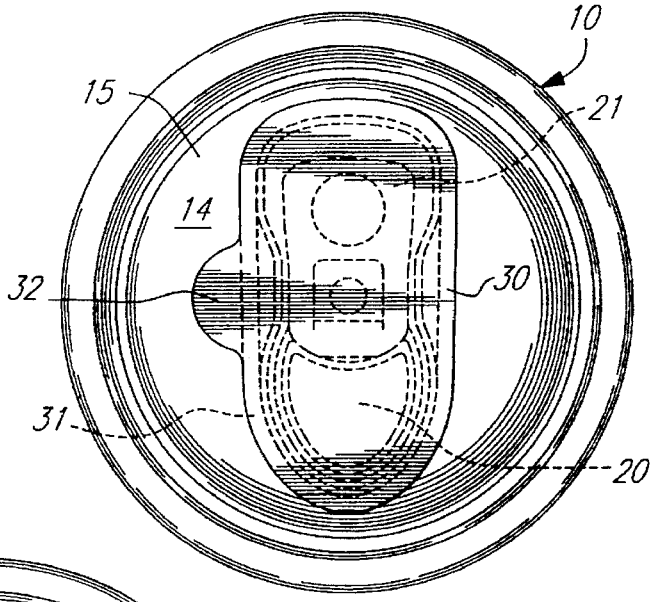
FIG. 5 is a top plan view of a third embodiment of the protective, removable cover according to the invention, installed onto a beverage can comprising a top wall.

In the embodiment of FIG. 5, the piece 30 of sheet material is contoured to cover both the stamped portion 20 and the tab opener 21. Again, the sheet material forming the piece 30 may comprise plastic sheet material, sheet metal or any other adequate sheet material. The strip of glue 31 is applied onto the outer surface 15 of the top wall 14 around the stamped portion 20 and the tab opener 21 and, then, the peripheral circular portion of the inner surface of the piece 30 of sheet material is applied to this strip 31 of glue. Of course, the strip 31 may comprise any glue or substance suitable to removably adhere the material forming the piece 30 to the outer surface 15 of the top wall 14 of the beverage can 10, normally made of aluminum. Finally, the piece 30 of sheet material advantageously comprises a peripheral tab 32 to facilitate manual removal of the piece 30 from the outer surface 15 of the top wall 14.

According to an alternative, the piece 30 of sheet material may be applied to the outer surface 15 of the top wall 14 in liquid state. Following its application, the liquid material dries to form the piece 30 having a self-adhering inner surface for removably gluing the piece 30 on the surface 15. It is believed to be within the skill of one of ordinary skill in the art to select a resinous, composite or other material enabling application and adhering of the piece 30 of sheet material to the outer surface 15 in a single operation while enabling easy removal of this piece 30 from the top wall 14.

Figure 6:
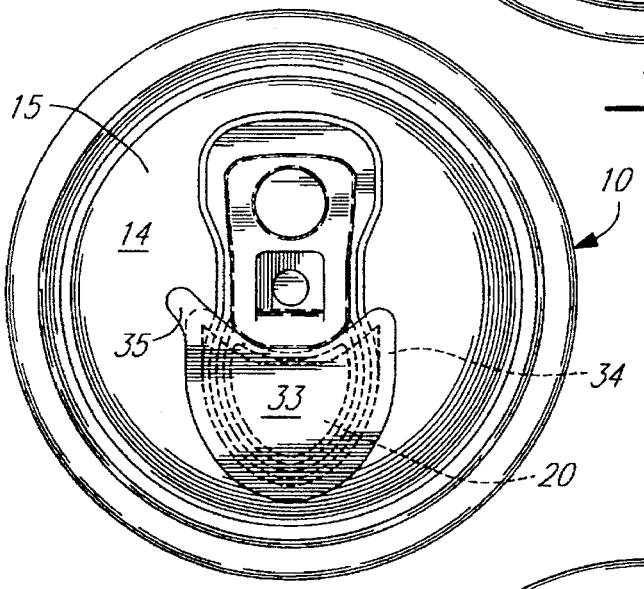
FIG. 6 is a top plan view of a fourth embodiment of the protective, removable cover according to the invention, installed onto a beverage can comprising a top wall.

In the embodiment of FIG. 6, the piece 33 of sheet material is contoured to cover a major part, i.e. most of the stamped portion 20 (opening means). Again, the sheet material forming the piece 33 may comprise plastic sheet material, sheet metal or any other adequate sheet material. The strip of glue 34 is applied onto the outer surface 15 of the top wall 14 as shown in FIG. 6 and, then, the peripheral circular portion of the inner surface of the piece 33 is applied to this strip 34 of glue. Of course, the strip 34 may comprise any glue or substance suitable to removably adhere the material forming the piece 33 to the outer surface 15 of the top wall 14 of the beverage can 10, normally made of aluminum. Finally, the piece 33 of sheet material advantageously comprises a peripheral tab 35 to facilitate manual removal of the piece 33 from the outer surface 15.

The piece 33 of sheet material may still be applied to the outer surface 15 of the top wall 14 in liquid state. Following its application, the liquid material dries to form the piece 33 of sheet material having a self-adhering inner surface for removably gluing the piece 33 on the surface 15. It is believed to be within the skill of one of ordinary skill in the art to select a resinous, composite or other material enabling application and adhering of the piece 33 of sheet material to the outer surface 15 in a single operation while enabling easy removal of this piece 33 from the top wall 14.

Figure 7:
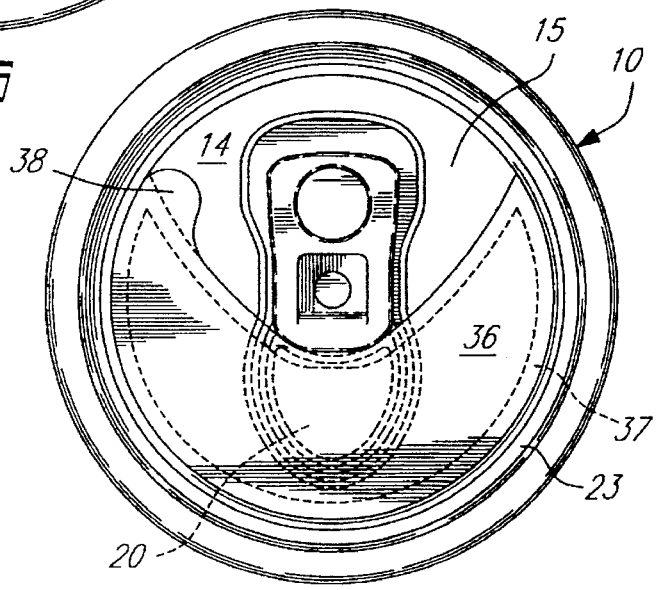
FIG. 7 is a top plan view of a fifth embodiment of the protective, removable cover according to the invention, installed onto a beverage can comprising a top wall.

In the last embodiment illustrated in FIG. 7, the piece 36 of sheet material is contoured to cover a half-moon section of the outer surface 15 of the top wall 14 of the beverage can 10, including a major part of the stamped portion 20. The sheet material forming the piece 36 may still comprise plastic sheet material, sheet metal or any other adequate sheet material. The strip of glue 37 is applied onto the outer surface 15 of the top wall 14 as illustrated in FIG. 7, inside the surface section 23 and, then, the peripheral circular portion of the inner surface of the piece 36 of sheet material is applied to this strip 37 of glue. The strip 31 may comprise any glue or substance suitable to removably adhere the material forming the piece 37 to the outer surface 15, normally made of aluminum. Finally, the piece 36 of sheet material advantageously comprises a peripheral tab 38 to facilitate manual removal of the piece 30 from the outer surface 15 of the top wall 14 of the beverage can 10.

Again, the piece 36 of sheet material may be applied to the outer surface 15 of the top wall 14 in liquid state. Following its application, the liquid material dries to form the piece 36 of sheet material having a self-adhering inner surface gluing the piece 36 on the surface 15. It is believed to be within the skill of one of ordinary skill in the art to select a resinous, composite or other material enabling application and adhering of the piece 36 of sheet material to the outer surface 15 in a single operation while enabling easy removal of this piece 36 from the top wall 14.

Therefore, the protective removable cover of the invention has no portion situated outside the top annular edge surface 18 of the peripheral lip 17 whereby it will not interfere with assembly of the beverage cans into six-packs. Also, the different strips of glue 25, 28, 31, 34 and 37 or the material applied in liquid state seal the periphery of the pieces of sheet material 24, 27, 30, 33 and 36, respectively, so that no dust, dirt, bacteria and the like can penetrate between the piece of sheet material and the outer top wall surface 15 of the beverage can 10.

Finally, it should be mentioned that, upon opening of the beverage can 10, the stamped portion 20 pushed into the can 10 is substantially free from dust, dirt, bacteria and the like to prevent contamination of the liquid contacting this portion 20.

Although the present invention has been described herein above with reference to preferred embodiments thereof, these embodiments can be modified at will, within the scope of the appended claims, without departing from the spirit and nature of the subject invention.

What is claimed is:

1. A protective, removable cover for a beverage container including a top wall having (a) an opening means, (b) an upwardly extending peripheral lip defining a top annular edge surface, and (c) an outer surface comprising a peripheral annular surface section adjacent to and inside said rod annular edge surface, said protective removable cover comprising:

a piece of sheet material for covering the opening means, the piece of sheet material having an inner surface with a peripheral annular portion contoured to fit on said peripheral annular surface section inside said top annular edge surface; and means for removably adhering said peripheral annular portion to said peripheral annular surface section.

2. A protective removable cover as recited in claim 1, wherein said adhesive means comprises a self-adhering inner surface of the piece of sheet material.

3. A protective, removable cover as recited in claim 1, wherein said adhering means comprises a strip of glue.

4. A protective, removable cover as recited in claim 3, wherein the sheet material is selected from the group consisting of plastic sheet material and sheet metal.

5. A protective, removable cover as recited in claim 3, wherein the piece of sheet material comprises an inwardly extending peripheral tab to facilitate manual removal thereof.

6. A protective, removable cover for a container including a top wall having (a) an upwardly extending peripheral lip defining a top annular edge surface and (b) an outer surface comprising a peripheral annular surface section adjacent to and inside said top annular edge surface, said protective removable cover comprising:

a piece of sheet material having an inner surface with a peripheral annular portion contoured to fit on said peripheral annular surface section inside said top annular edge surface; and means for removably adhering said peripheral annular portion to said peripheral annular surface section.

7. A protective, removable cover as retired in claim 6, wherein said adhesive means comprises a self-adhering inner surface of the piece of sheet material.

8. A protective, removable cover as recited in claim 6, wherein said adhering means comprises a strip of glue.

9. A protective, removable cover as recited in claim 8, wherein the sheet material is selected from the group consisting of plastic sheet material and sheet metal.

10. A protective, removable cover as recited in claim 9, wherein the piece of sheet material comprises an inwardly extending peripheral tab to facilitate manual removal thereof.

* * * * *